US005619809A

United States Patent [19]

Sessa

[11] Patent Number: 5,619,809

[45] Date of Patent: Apr. 15, 1997

[54] SHOE SOLE WITH AIR CIRCULATION SYSTEM

[76] Inventor: Raymond Sessa, 5123 S. Quail Crest, Grand Rapids, Mich. 49546

[21] Appl. No.: 530,999

[22] Filed: Sep. 20, 1995

[51] Int. Cl.[6] ..... A43B 13/18

[52] U.S. Cl. ..... 36/3 R; 36/3 B; 36/28; 36/30 R

[58] Field of Search ..... 36/3 R, 3 B, 25 R, 36/28, 29, 30 R, 35 R, 37

[56] References Cited

U.S. PATENT DOCUMENTS

| | | | |
|---|---|---|---|
| 455,847 | 7/1891 | Howard et al. . | |
| 945,698 | 1/1910 | Conway . | |
| 2,302,706 | 11/1942 | Margolin . | |
| 2,329,209 | 9/1943 | Manson et al. . | |
| 2,358,342 | 9/1944 | Margolin . | |
| 2,437,065 | 3/1948 | Austin . | |
| 2,552,711 | 5/1951 | Dunker . | |
| 3,280,484 | 10/1966 | Sensi . | |
| 3,785,069 | 1/1974 | Brown . | |
| 3,834,046 | 9/1974 | Fowler | 36/28 |
| 4,071,963 | 2/1978 | Fukuoka | 36/3 B |
| 4,187,620 | 2/1980 | Selner | 36/28 |
| 4,215,492 | 8/1980 | Sandmeier | 36/3 B |
| 4,222,185 | 9/1980 | Giaccaglia | 36/3 B |
| 4,223,455 | 9/1980 | Vermeulen | 36/3 B |
| 4,616,431 | 10/1986 | Dassler | 36/30 R |
| 4,776,109 | 11/1988 | Sacre | 36/3 B |
| 4,974,345 | 12/1990 | Yung-Mao | 36/28 |
| 5,235,761 | 8/1993 | Chang . | |
| 5,400,526 | 3/1995 | Sessa . | |

FOREIGN PATENT DOCUMENTS

| | | | |
|---|---|---|---|
| 3507295 | 9/1986 | Germany | 36/28 |
| 499470 | 1/1939 | United Kingdom . | |
| 1444091 | 7/1976 | United Kingdom | 36/28 |
| 3003639 | 3/1993 | WIPO | 36/28 |

*Primary Examiner*—M. D. Patterson
*Attorney, Agent, or Firm*—Warner Norcross & Judd

[57] ABSTRACT

A footwear sole assembly for providing air circulation around the foot and also providing improved resilient cushioning. The assembly includes an outsole and an insert suspended above the outsole in trampoline-like fashion to define an air chamber therebetween. As the wearer strides, the insert moves toward the outsole compressing the air contained in the air chamber and causing that air to flow onto the foot through the apertures in the insert. Preferably, the outsole defines a plurality of upwardly opening pockets; and the insert includes a plurality of downwardly extending pins aligned with the pockets. The flexing action of the insert also drives the pins down into the pockets where they are deformed to absorb the impact of the stride.

23 Claims, 5 Drawing Sheets

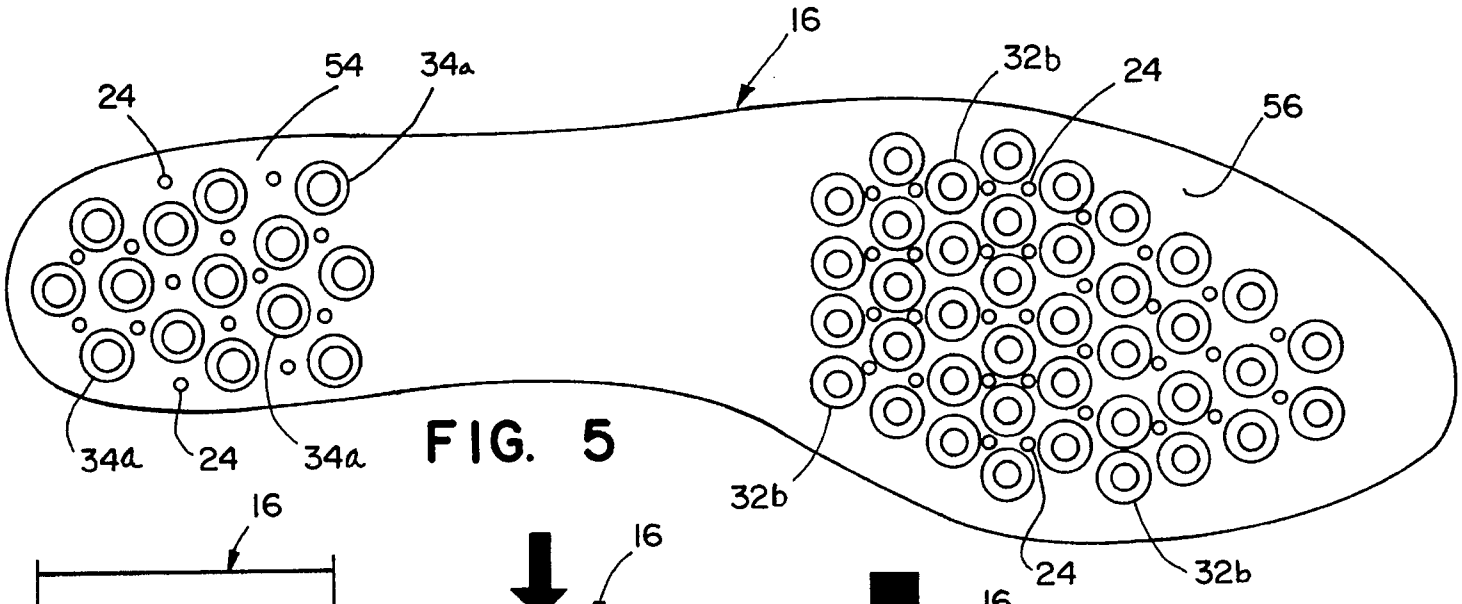
FIG. 5
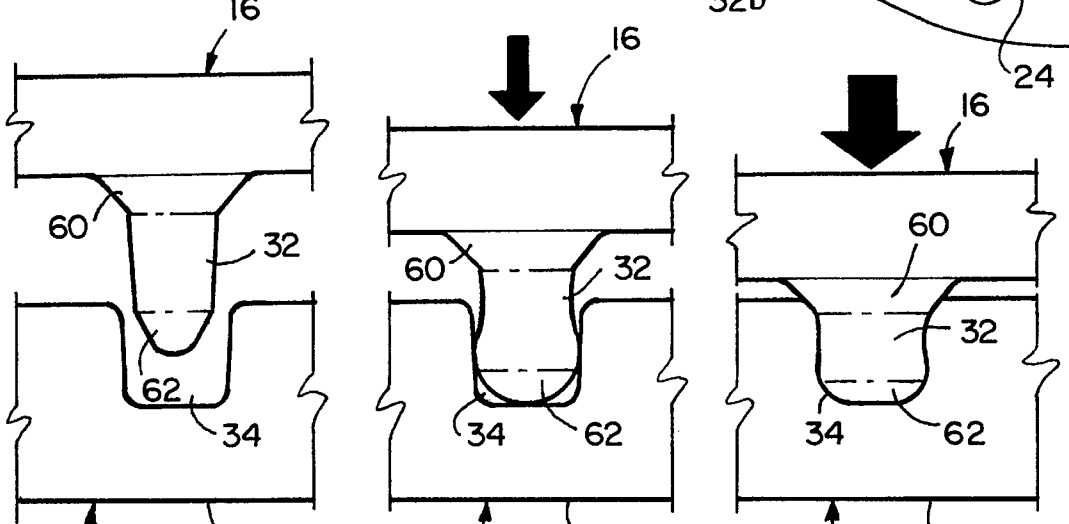
FIG. 7C
FIG. 7B
FIG. 7A

SHOE SOLE WITH AIR CIRCULATION SYSTEM

BACKGROUND OF THE INVENTION

The present invention relates to footwear, and more particularly to a sole assembly having an air circulation system.

Footwear manufacturers continually work to improve the comfort of their products. One method for improving the comfort of conventional footwear is to provide a system for circulating air around the foot. Air circulation systems prevent stagnant air from being trapped around the foot where it can retain heat and moisture which not only make the footwear uncomfortable, but also provide a breeding-ground for bacteria. A conventional air circulation system includes a bladder or similar pumping device contained within the sole assembly or within a shoe insert. As the wearer steps down on the footwear, the bladder or pumping device is compressed forcing air contained therein to circulate over the foot through openings in the insole. When the wearer's weight is lifted from the footwear, the bladder or pumping device expands to refill with air. The process repeats itself with every stride.

A shoe having a sole assembly with an integrated air circulation system is disclosed in U.S. Pat. No. 5,235,761 issued Aug. 17, 1993 to Chang. Chang includes a number of springloaded air chambers between the outsole and insole. The sole assembly includes an upper layer having downwardly opening cups that are telescopically received within upwardly opening cups defined by a lower layer. A spring is fitted between the cups to bias the upper layer away from the lower layer. When the wearer steps down upon the sole, the springs are compressed and the cups telescope forcing air from the chambers into the shoe. When the foot is lifted, the springs return the chambers to their full volumes drawing in fresh air. The air circulation system of Chang is relatively complex in structure. In addition, the volume of air displaced by the system during each stride is limited to the internal volume of the telescoping cups. Further, the springs provide the sole assembly with less than ideal resiliency for many applications.

Another type of air circulation system is disclosed in U.S. Pat. No. 2,358,342 issued Sep. 19, 1944 to Margolin. The bottom of the Margolin arch support includes a number of channels or grooves that, when compressed, pump air onto the foot through apertures in the insert. The Margolin arch support also includes a number of resilient lugs that extend downwardly from its bottom surface. The lugs are sized and positioned to provide the arch support with the desired resiliency. The volume of air displaced by the Margolin system during each stride is limited to the internal volume of the channels. Additionally, the peripheral edges of the Margolin insert are open, thereby allowing air to vent around the sides until the channels are sealed against the insole.

SUMMARY OF THE INVENTION

The aforementioned problems are overcome by the present invention which provides a sole assembly having an apertured insert suspended above an outsole in trampoline-like fashion to define an air chamber therebetween. As the wearer steps down on the sole assembly, the insert flexes downwardly forcing air from the air chamber through the apertures in the insert and onto and around the foot. When weight is released from the insert, the membrane returns to its original position lifting the insert and drawing air back into the air chamber. The process repeats itself with each stride.

In a second aspect of the invention, the outsole defines a plurality of upwardly opening pockets, and the insert includes a plurality of downwardly depending pins extending into the pockets. The pin/pocket combinations act as shock absorbers. When the insert flexes downwardly, the pins engage the walls of the corresponding pockets providing resistance to further downward movement. As the insert continues to flex, the pins are increasingly deformedαeventually filling the pockets. As the pins increasingly fill the pockets, the pockets provide increasingly greater resistance to further deformation of the pins. When the load is lifted from the sole assembly, the pins return to their original shape providing the sole with resilient comfort.

The present invention provides a unique sole assembly with both effective air circulation and improved comfort over widely varying loads. The moving insert provides the sole assembly with a trampoline-like resiliency, and the pin/pocket provides controlled resiliency over a range of loads. Further, the relatively large volume of the air chamber provides ample air circulation.

These and other objects, advantages, and features of the present invention will be more readily understood and appreciated by reference to the detailed description of the preferred embodiment and the drawings.

BRIEF DESCRIPTION OF THE DRAWINGS

FIG. 5 is a bottom plan view of the insert;

FIGS. 7A, 7B, and 7C are enlarged sectional views of area VII in FIG. 2 showing increasing deformation of the pins as the load increases.

DETAILED DESCRIPTION OF THE PREFERRED EMBODIMENT

Figure 1:
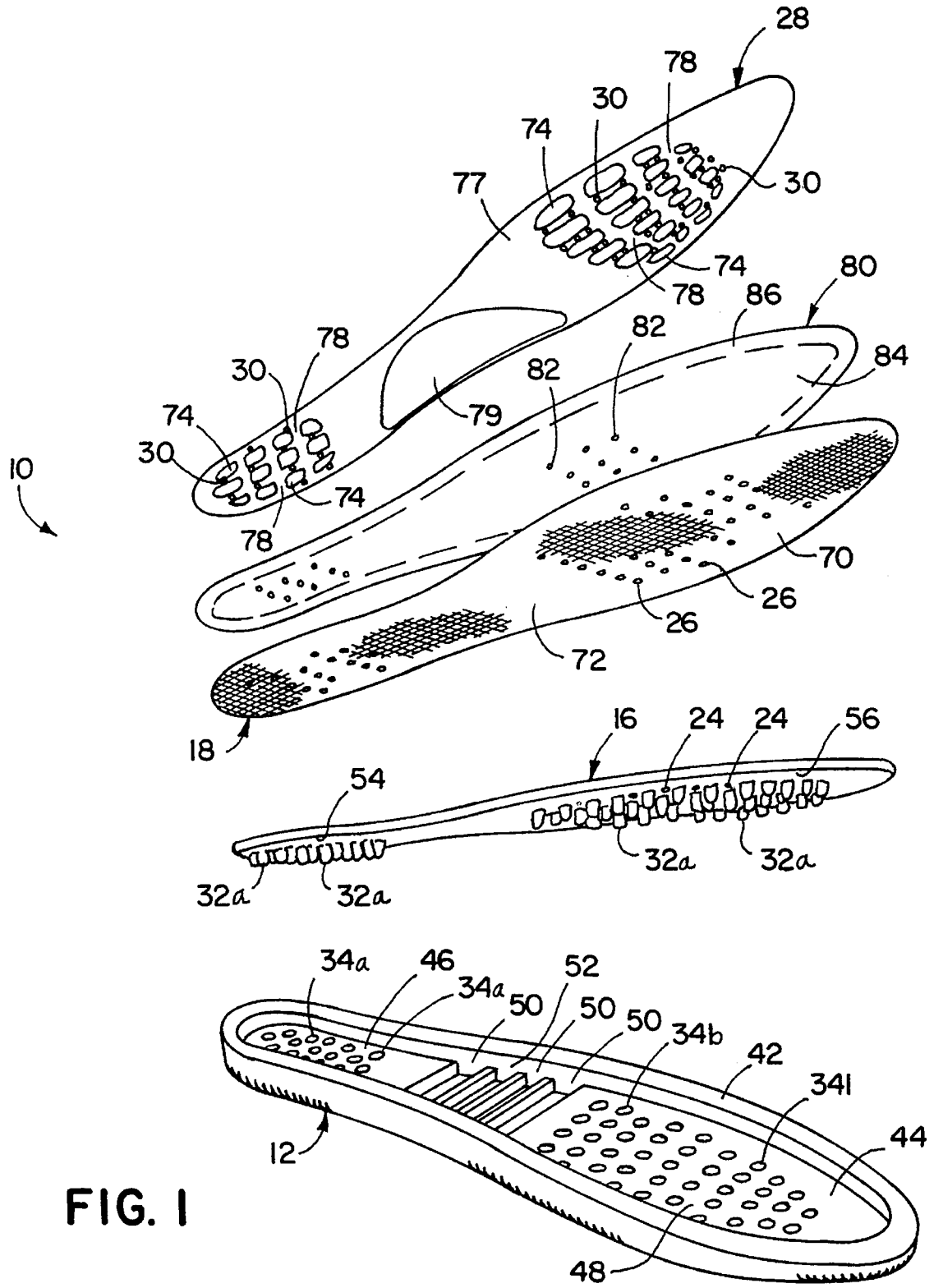
FIG. 1 is an exploded perspective view of the sole assembly.
Figure 6:
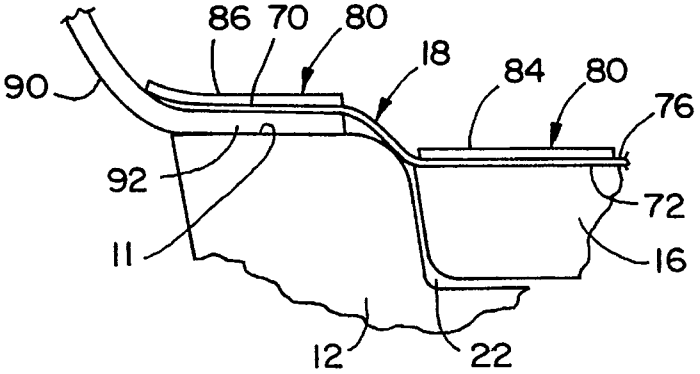
FIG. 6 is an enlarged sectional view of area VI in FIG. 2 showing the insole in a flexed position.
Figure 3:
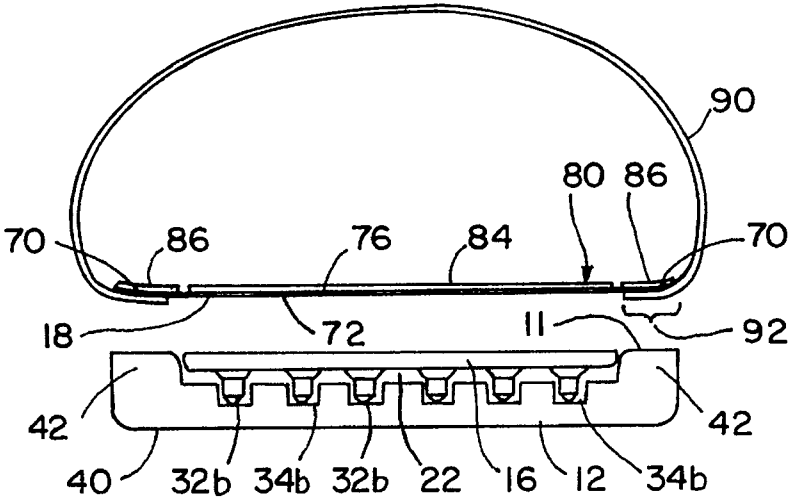
FIG. 3 is a partially exploded sectional view taken along line III—III in FIG. 2.

A sole assembly according to a preferred embodiment of the present invention is illustrated in FIG. 1, and generally designated 10. The sole assembly 10 is intended for use with a wide variety of conventional uppers allowing it to be incorporated into shoes, boots, sandals and other soled footwear. The style of the upper and the manner of securing it to the sole assembly 10 will vary depending on the design of the footwear. However, in the preferred embodiment, the upper 90 is secured at its lasting allowance 92 to the lasting margin 11 of the sole assembly using conventional cement lasting techniques.

Figure 2:
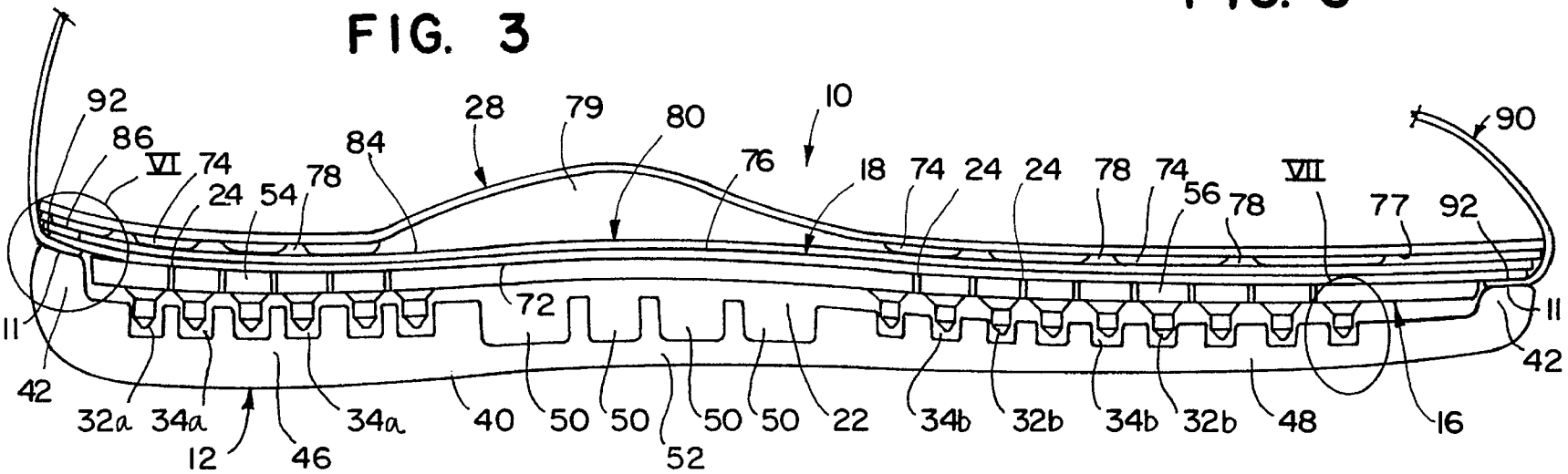
FIG. 2 is a sectional side elevational view of a shoe incorporating the sole assembly.
Figure 4:
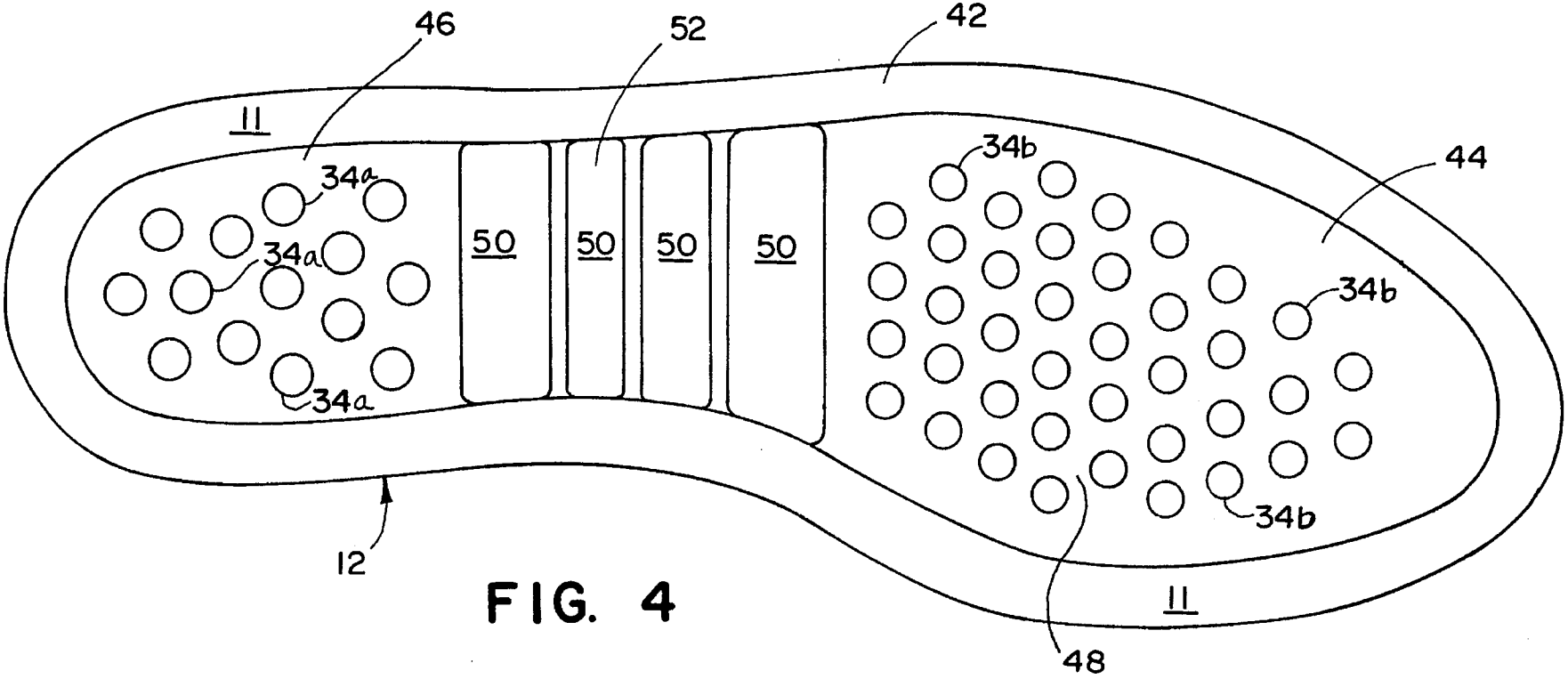
FIG. 4 is a top plan view of the outsole.
Figure 8:
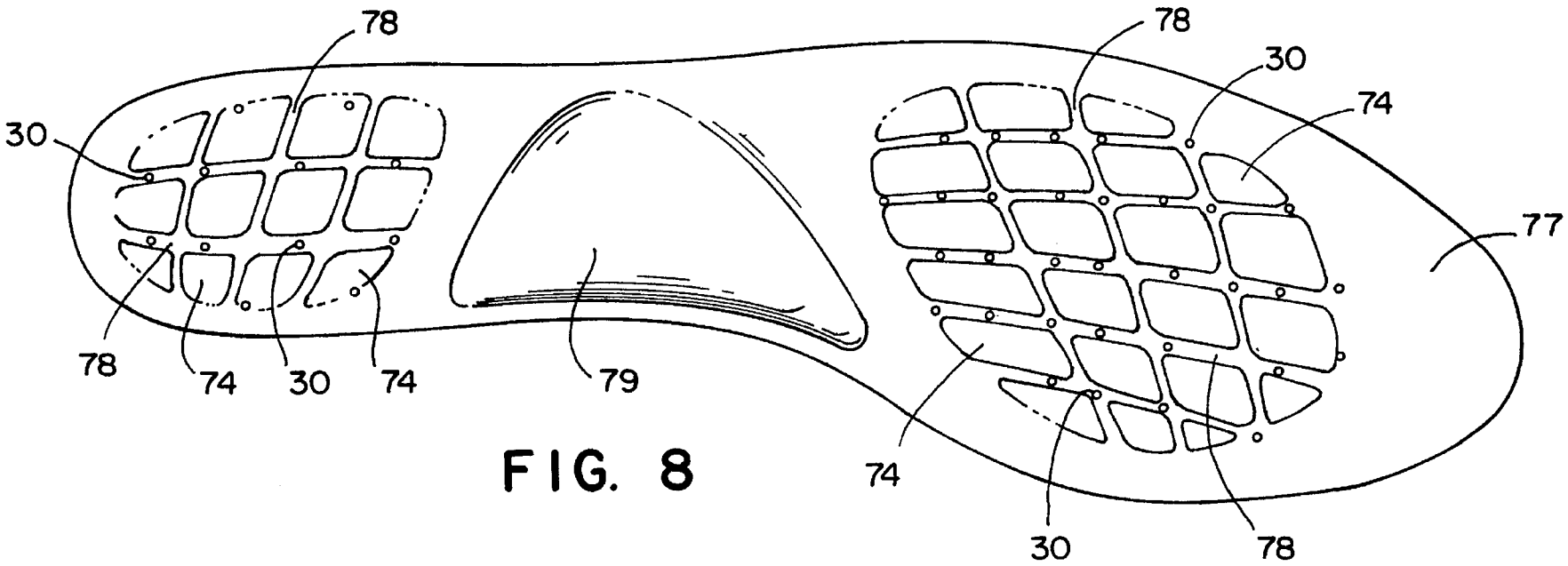
FIG. 8 is a bottom plan view of the orthotic.

The sole assembly 10 includes an outsole 12 that forms the wear surface of the sole assembly 10. An insert 16 is suspended above the outsole 12 by an elastic membrane 18 to define an air chamber 22 (See FIG. 2). A plurality of apertures 24 and 26 are defined in the insert 16 and membrane 18 to allow air to flow into and out of the air chamber 22. The membrane 18 may be lined with an appropriate insole 80. An orthotic 28 extends above the insole 80 and includes a plurality of apertures 30 to allow air to flow therethrough. During walking, the membrane 18 flexes downward to force air from the air chamber 22. The air flows up through the insert 16, membrane 18, insole 80, and orthotic 28 to the foot (not shown). The pumping action of the sole assembly 10 repeats with each stride.

In the preferred embodiment, the outsole 12 is manufactured from a durable, wear resistant material, such as a polyurethane, having a relatively high durometer (e.g. in the range of 55 to 65). The lower surface 40 of the outsole forms the wear surface of the completed shoe. This surface 40 can be shaped and/or textured as desired (e.g. to provide a non-slip surface). For example, the lower surface can be provided with cleats, lugs, ribs or other tread patterns. The outsole 12 includes a peripheral wall 42 that defines a recess 44 for receiving the insert 16.

The heel portion 46 of the outsole 12 defines a plurality of upwardly opening pockets 34*a*. The pockets 34*a* are preferably cylindrical and have a diameter slightly larger than the insert pins 32*a* described below. The ball portion 48 of the outsole also defines a plurality of upwardly opening pockets 34*b*. Like pockets 34*a*, pockets 34*b* are preferably cylindrical and have a diameter slightly larger than the insert pins 32*b*.

Additionally, a series of transverse channels 50 extend through the arch portion 52 of the outsole 12 to allow the outsole to flex properly. The size, location, and number of channels will vary from application to application depending on the desired flexibility and the material from which the outsole is manufactured. In certain applications, the channels 50 can be eliminated all together.

The insert 16 is preferably manufactured from a material having a lower durometer (e.g. in the range 30 to 35) than the outsole 12. This provides an improved cushioning effect under normal loads. The thickness of the insert 16 is substantially less than the depth of recess 44 such that air chamber 22 is defined between the two components. A plurality of pins 32*a* and 32*b* depend downwardly from heel portion 54 and ball portion 56, respectively. As the insert moves downward under a load, pins 32*a–b* engage upwardly opening pockets 34*a–b* to absorb the impact energy and provide the sole with the desired resiliency. When the load on the sole assembly is lifted, the resilient insert 16 and membrane 18 return to their original shape drawing air from around the foot back into the air chamber 22. In use, the heel portion of the sole assembly is subjected to larger impact forces than the heel portion. Consequently, pins 32*a* are preferably larger in diameter than pins 32*b*. The larger diameter pins 32*a* provide greater resistance to deformation and therefore provide the heel portion with the desired resilience. Pins 32*a–b* are arranged in patterns identical to that of the outsole pockets 32*a–b* such that each pin is uniquely aligned with a single outsole pocket. As noted above, the pattern of the pins and pockets can be altered to control the resiliency of the sole assembly 10.

As perhaps best illustrated in FIG. 7A, each pin includes a tapered base 60 and a rounded end 62. The length of each pin is greater than the depth of the corresponding pocket. This allows the pin to deform and eventually fill the pocket when subjected to a load. FIGS. 7A–C illustrate pin deformation under varying loads. FIG. 7A shows pin 32 suspended over pocket 34 when no load is applied to the sole assembly 10. FIG. 7B shows the pin 32 beginning to deform under normal load. Pocket 34 does not significantly restrict deformation of pin 32. FIG. 7C shows pin 32 and pocket 34 under impact forces. Impact forces cause pin 32 to increasingly fill pocket 34. As pin 32 engages the walls of pocket 34, further outward deformation is resisted by the wails of the pocket as well as by the pin itself. This enhances the ability of the sole assembly to resist high impact forces.

The diameter of the pins and pockets can be varied to control the resilience of the insole assembly 10. For example, insert pins 32*a* and outsole pockets 34*a* are preferably larger in diameter than insert pins 32*b* and outsole pockets 34*b*. This allows the heel portion to properly absorb the impact forces generated at the heel of the foot. The pattern or arrangement of the pockets and pins can also be selected to vary the resiliency of the sole assembly from location to location. For example, the pins and pockets can be placed closer together in areas where higher impact forces are anticipated. Preferably, pockets 34*b* are arranged in traverse rows across the ball portion and pockets 34*a* are staggered evenly throughout the heel portion.

Additionally, the relationship between the diameter of the pockets and the diameter of the pins can be varied to control the resiliency of the sole assembly. For example, smaller diameter pockets can increase the resiliency of the sole assembly by preventing outward deformation of the pins at lower loads.

The insert 16 defines a plurality of apertures 24 to allow air to flow into and out of air chamber 22. The apertures 24 are preferably arranged evenly throughout the ball and heel portions of the insert to provide relatively even flow of air onto the ball and heel portions of the foot. The diameter of these apertures 24 will vary from application to application depending on the desired air flow and resiliency characteristics. For example, the apertures can be reduced in diameter to restrict the flow of air from air chamber 22 and provide a firmer sole assembly 10.

The elastic membrane 18 is preferably manufactured from industrial strength elastic fabric. A suitable material is available from A & W Supply of Brockton, Mass. The elastic membrane 18 is secured around its peripheral edge 70 to the lasting allowance 92 of upper 90, preferably by an adhesive. The elastic membrane 18 is secured to the upper in a flexed condition so that it has sufficient tension to suspend the insert 16 with recess 44. The membrane must also be capable of flexing downwardly into recess 44 when a load is applied to the sole assembly 10. The elastic membrane 18 includes a plurality of apertures 26 which allow air to flow into and out of air chamber 22. Apertures 26 are aligned with apertures 24, allowing air to flow easily through both insert 16 and elastic membrane 18. The insert 16 is secured to the bottom surface 72 of the membrane 18, preferably by an adhesive.

A generally conventional insole 80 can be secured to the upper surface 76 of the membrane 18 to make the sole assembly 10 more comfortable. The insole 80 preferably includes a central portion 84 and a peripheral portion 86. The two portions 84 and 86 are separated to allow the elastic membrane 18 to flex freely under the load. The insole 80 is preferably a flexible fabric secured to the membrane 18 by conventional adhesive. Alternatively, the insole 80 can remain separate from the membrane 18 so that it is easily removed and replaced. The insole 80 preferably defines a plurality of apertures 82 aligned with apertures 26 such that air can flow easily through the insole 80. Alternatively, the insole 80 can be manufactured from an open, breathable fabric that allows air to pass therethrough without apertures.

Orthotic 28 is disposed above the insole 80 to provide orthopedic support for the foot. The orthotic 28 includes an arch support 79 and is preferably removably fitted above the insole 80. The shape of the orthotic is generally conventional and can vary from application to application. The orthotic 28 is manufactured from conventional materials and defines a plurality of apertures 82 which allow air to flow therethrough. In addition, the orthotic 28 includes a plurality of bulbous protrusions 74 depending downwardly from its lower surface 77 at both the heel and ball areas. The protrusions provide cushioning support for the orthotic 28 and are preferably manufactured from a soft polyurethane. The protrusions 74 are separately manufactured from the orthotic and are secured using conventional adhesive. Alternatively, the protrusions 74 can be integrally formed with the orthotic. In either event, the protrusions 74 are arranged to define a series of channels 78 such that air can move between apertures 82 and apertures 30.

Manufacture

The present invention is manufactured by separately forming the individual components and then assembling them as described below. The outsole 12 and insert 16 are preferably manufactured with conventional molding techniques and apparatus. The elastic membrane 18 and insole 80 are preferably die cut to shape from the desired material. The orthotic 28 is preferably molded or otherwise formed using conventional methods, and then the protrusions 74 are secured thereto by adhesives.

Once the outsole 12 is formed, the upper 90 is secured along its lasting allowance 92 to the lasting margin 11 of the outsole—preferably by conventional adhesives. Next the insert 16 is secured to the lower surface of the elastic membrane 18 by an adhesive. Afterwards, the membrane 18 is secured along its periphery of the lasting allowance 92 of the upper 90 with the insert 16 extending into recess 44. The membrane 18 is preferably secured to the upper 90 by adhesives or stitching. The insole 80 is then placed atop the membrane 18. It can be secured in place by adhesives or stitching if desired. And finally, the orthotic 28 is positioned above the insole 80 to complete the assembly. The orthotic 28 is preferably not secured to the insole 80.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. An article of footwear comprising:

an upper;

an outsole defining a plurality of upwardly opening pockets each having a circumferential wall;

an insert above said outsole and deeming an air chamber therebetween, said insert including a plurality of pins each extending toward one of said pockets, each of said pins having a circumferential wall dimensioned to engage the associated pocket wall, said insert defining a plurality of apertures which allow air to flow into and out of said air chamber; and support means for flexibly suspending said insert above said outsole, said support means disposed above said insert and including a periphery, said support means affixed around said periphery to said upper, said support means being sufficiently flexible to allow said insert to move toward said outsole when a load is applied to said insert, whereby said pins engage said pockets to provide cushioning, and further whereby air is expelled from said air chamber through said insert apertures.

2. The article of claim 1 wherein said flexible support means includes an elastic membrane secured to said insert.

3. The article of claim 1 wherein each of said pockets have a depth and include a bottom wall, said pins having a length greater than said depth of the associated pocket, whereby said pins engage said bottom wall and deform outwardly to firmly engage said circumferential walls when a load is applied to said insert.

4. The article of claim 3 wherein said pockets and said pins are generally circular in cross section.

5. The article of claim 4 wherein each of said pins includes an outwardly tapered base and a rounded end.

6. The article of claim 5 wherein said outsole assembly includes a heel portion and a ball portion, at least some of said pins disposed in said heel portion and at least some of said pins disposed in said ball portion, said pins in said heel portion having a larger diameter than said pins in said ball portion.

7. The article of claim 6 wherein said outsole defines an upwardly opening recess, said insert being fitted within said recess.

8. The article of claim 7 further comprising an orthotic disposed above said insert and having upper and lower surfaces, said orthotic including a plurality of resilient protrusions on said lower surface, said resilient protrusions defining a series of channels aligned with said insert apertures.

9. A footwear sole assembly comprising:

an outsole defining an upwardly opening recess and a plurality of upwardly opening pockets disposed within said recess, each of said pockets having a depth;

an elastic membrane extending above said outsole, said membrane having an undersurface; and an insert secured to said undersurface of said membrane and fitted within said recess, said insert including a plurality of downwardly depending pins, each of said pins being aligned and uniquely associated with one of said pockets, each of said pins having a length greater than the depth of the associated pocket, said elastic membrane being sufficiently flexible to allow said insert to increasingly move toward said outsole when a load is applied to said sole assembly such that said pins engage and are increasingly deformed within said pockets.

10. The sole assembly of claim 9 wherein said pockets are defined by a plurality of walls; and wherein pins deform outwardly to engage said walls when a load is applied to said sole assembly.

11. The sole assembly of claim 10 wherein said pockets and said pins are generally circular in cross section.

12. The sole assembly of claim 11 wherein each of said pins includes an outwardly tapered base and a rounded end.

13. The sole assembly of claim 12 wherein said outsole assembly includes a heel portion and a ball portion, said pins in said heel portion having a larger diameter than said pins in said ball portion.

14. The sole assembly of claim 13 further comprising an orthotic disposed above said elastic membrane, said orthotic defining a plurality of apertures and including a plurality of downwardly depending resilient protrusions defining a series of channels extending between said apertures.

15. A sole assembly comprising:

an outsole including a peripheral wall having an upper surface and defining an upwardly opening recess and a plurality of upwardly opening pockets;

an elastic membrane secured around its periphery to said upper surface of said peripheral wall, said membrane having an undersurface; and an insert secured to and suspended beneath said undersurface of said membrane within said recess, said insert including a plurality of apertures and being spaced apart from said outsole to define an air chamber therebetween, said insert including a plurality of downwardly depending pins, each of said pins being aligned and uniquely associated with one of said pockets, said elastic membrane being sufficiently flexible to allow said insert to move toward said outsole when a load is applied to said sole assembly such that air trapped within said air chamber is expelled through said apertures.

16. The sole assembly of claim 15 wherein each of said pockets have a depth, each of said pins being aligned and uniquely associated with one of said pockets, said pins being resilient and having a length greater than said depth of the associated pockets such that said pins are increasingly deformed within said pockets when an increasing load is applied to said sole assembly.

17. The sole assembly of claim 16 wherein said pins deform to substantially fill said pockets when impact forces are applied to said sole assembly.

18. An article of footwear comprising:

an outsole defining a plurality of upwardly opening pockets;

an upper secured to said outsole;

an insert above said outsole and defining an air chamber therebetween, said insert defining a plurality of apertures which allow air to flow into and out of said air chamber, said insert including a plurality of downwardly depending pins, each of said pins being aligned and uniquely associated with one of said pockets; and support means for flexibly suspending said insert above said outsole, said support means having an undersurface and being affixed to said upper, said insert secured to said undersurface, said support means being sufficiently flexible to allow said insert to move toward said outsole when a load is applied to said insert, whereby air is expelled from said air chamber through said insert apertures to circulate air around a wearer's foot.

19. The article of claim 18 wherein said flexible support means includes an elastic membrane secured to said insert.

20. The article of claim 19 further comprising an orthotic disposed above said insert and having upper and lower surfaces, said orthotic including a plurality of resilient protrusions on said lower surface, said resilient protrusions defining a series of channels aligned with said insert apertures.

21. An article of footwear comprising:

an outsole defining a plurality of upwardly opening pockets each having a depth and a circumferential wall;

an upper secured to said outsole;

an insert above said outsole and including a plurality of resiliently flexible pins each aligned with one of said pockets, each of said pins having a length greater than said depth of the associated pocket, each of said pins including a circumferential wall; and support means for flexibly suspending said insert above said outsole, said support means having an undersurface and being connected to said upper, said insert secured to said undersurface, said support means being sufficiently flexible to allow said insert to move toward said outsole when a load is applied to said insert, whereby said pins extend into said pockets and flex outwardly into engagement with said pocket peripheral walls to provide shock absorption.

22. The article of claim 21 wherein said pockets and said pins are generally circular in cross section.

23. The article of claim 22 wherein said outsole assembly includes a heel portion and a ball portion, said pins in said heel portion having a larger diameter than said pins in said ball portion.

* * * * *

UNITED STATES PATENT AND TRADEMARK OFFICE

CERTIFICATE OF CORRECTION

PATENT NO. : 5,619,809

DATED : April 15, 1997

INVENTOR(S) : Raymond Sessa

It is certified that error appears in the above-indentified patent and that said Letters Patent is hereby corrected as shown below:

Column 5, Claim 1, Line 54:
delete "deeming" and insert --defining--

Signed and Sealed this

Twenty-second Day of July, 1997

Bruce Lehman

*Attest:*

BRUCE LEHMAN

*Attesting Officer*

*Commissioner of Patents and Trademarks*